US005435626A

United States Patent [19]

Lai

[11] Patent Number: 5,435,626

[45] Date of Patent: Jul. 25, 1995

[54] ARMREST-ADJUSTING MECHANISM

[76] Inventor: Yu-Shan Lai, No. 48, Tachuwei Tachu Village Shuishang Hsiang, Chiayi Hsien, Taiwan

[21] Appl. No.: 262,894

[22] Filed: Jun. 21, 1994

[51] Int. Cl.[6] ..... A47C 7/54

[52] U.S. Cl. ..... 297/411.36

[58] Field of Search ..... 297/353, 411.36

[56] References Cited

U.S. PATENT DOCUMENTS

| | | | |
|---|---|---|---|
| 4,749,230 | 6/1988 | Tornero | 297/353 |
| 5,265,938 | 11/1993 | Melhuish et al. | 297/411.36 |
| 5,318,347 | 6/1994 | Tseng | 297/411.36 |
| 5,324,096 | 6/1994 | Schultz | 297/411.36 |

FOREIGN PATENT DOCUMENTS

| | | | |
|---|---|---|---|
| 166870 | 1/1986 | European Pat. Off. | 297/411.36 |

*Primary Examiner*—Peter R. Brown

*Attorney, Agent, or Firm*—Browdy and Neimark

[57] ABSTRACT

An armrest-adjusting mechanism comprising an adjusting seat, a control board, a lower support and a locking block. The lower support is fitted in the adjusting seat and has a lengthwise slot and each lateral side of the slot is formed with multiple equally spaced arch adjusting notches. The control board has an arch pressing portion, whereby when the control board is moved upward or downward, the locking block is pressed by the pressing portion of the control board and locked in or unlocked from the arch adjusting notches of the lower support.

1 Claim, 3 Drawing Sheets

ARMREST-ADJUSTING MECHANISM

BACKGROUND OF THE INVENTION

The present invention relates to an armrest-adjusting mechanism.

An office chair is inevitable for a worker who works in an office. Because such worker always sits on the office chair through a long time during working, a comfortable office chair is required so as to avoid any ill affection on the worker caused by improper sitting attitude. Therefore, the current office chair is mostly designed according to the profile of human body. However, the profile of human body varies and therefore the office chair is often provided with several kinds of adjusting mechanisms, including armrest-adjusting mechanism for meeting the requirements of different persons.

A conventional armrest-adjusting mechanism, as shown in FIG. 1, is mainly composed of a lower support 1, an upper support 2, a rotary disk 3 and a bearing board 4. An upper portion of the lower support 1 is formed with a recess 11. A member having multiple equally spaced and vertically arranged semicircular notches 12 is disposed in the recess 11. Each of the semicircular notches 12 is open in the same direction as the recess 11. In addition, an upright stopper plate 13 is disposed on an outer side of semicircular notches 12. The stopper plate 13 has a length substantially equal to the width of the recess 11. A resilient pressing strip 14 is disposed in the recess 11 on a lateral side of the stopper plate 13 so as to tightly press against the stopper plate 13.

The upper support 2 is a hollow member, having an interior space 21 for receiving the lower support 1. An elliptic hole 22 is formed on the upper support 2 such that when the upper support 2 is fitted onto the lower support 1 at a lowest position, a bottom side of the elliptic hole 22 is flush with a bottom side of the recess 11. Furthermore, on two lateral sides of the elliptic hole 22 are respectively formed two circular depressions 23 for respectively receiving the rotary disk 3 and the bearing board 4.

The rotary disk 3 is an integrally formed member, having an outer swiveling button portion 31 and an inner disk portion 32 received in the elliptic hole 22. The disk portion 32 has a diameter substantially equal to the distance between an upper end and a lower end of the elliptic hole 22 while smaller than the distance between a left end and a right end of the elliptic hole 22. The disk portion 32 has two cylindric projections 321 positioned between the semicircular notches 12 and the stopper plate 13.

The bearing board 4 is disposed in one of the circular depressions 23 and formed with thread holes 41 through which screws 42 pass to secure the rotary disk 3 and bearing board 4 in the upper support 2.

According to the above arrangements, after the upper support 2 is fitted into the lower support 1, the two cylindric projections 321 of the rotary disk 3 are inserted into the semicircular notches 12 of the lower support 1 and pressed by the resilient pressing strip 14 and the stopper plate 13. Therefore, when the rotary disk 3 is rotated, the two cylindrical projections 321 thereof change their positions in the semicircular notches 12 so as to adjust the position of the armrest.

In the above conventional armrest-adjusting mechanism, several shortcomings exist as follows:

1. The cylindrical projections of the rotary disk are inserted into the semicircular notches of the lower support and pressed by the resilient pressing strip and stopper plate, so that when the positions of the cylindrical projections in the semicircular notches change for adjusting the height of the armrest, a considerably large force is required for the cylindrical projections to bias the resilient pressing strip and stopper plate outward. Therefore, it is labor-consuming to adjust the height of the armrest.

2. The adjustment is accomplished by means of interchanging the positions of the two cylindrical projections of the rotary disk in the multiple equally spaced semicircular notches, so that each time the rotary disk is rotated, the armrest only moves through a distance between two adjacent semicircular notches. Therefore, in case it is necessary to adjust the armrest through a long distance, the adjusting procedure will be inconvenient and cost much time.

3. The adjusting mechanism includes many complex components so that the manufacturing cost is high and it is difficult to assemble these components.

SUMMARY OF THE INVENTION

It is a primary object of the present invention to provide an improved armrest-adjusting mechanism to solve the above problems. The improved armrest-adjusting mechanism includes a control board having an arch pressing portion for pressing a locking block and separating the same from the arch adjusting notches of the lower support so as to accomplish the adjustment of height. When reaching a desired height, the control board is released, permitting the locking block to again lock with the lower support and fix the armrest at the desired height. Therefore, the adjustment can be completed quickly by one operation.

It is a further object of the present invention to provide the above armrest-adjusting mechanism by which the armrest is adjusted stagelessly through one operation and the labor as well as time for the adjustment are saved.

The present invention can be best understood through the following description and accompanying drawings, wherein:

DETAILED DESCRIPTION OF THE PREFERRED EMBODIMENT

Figure 1:
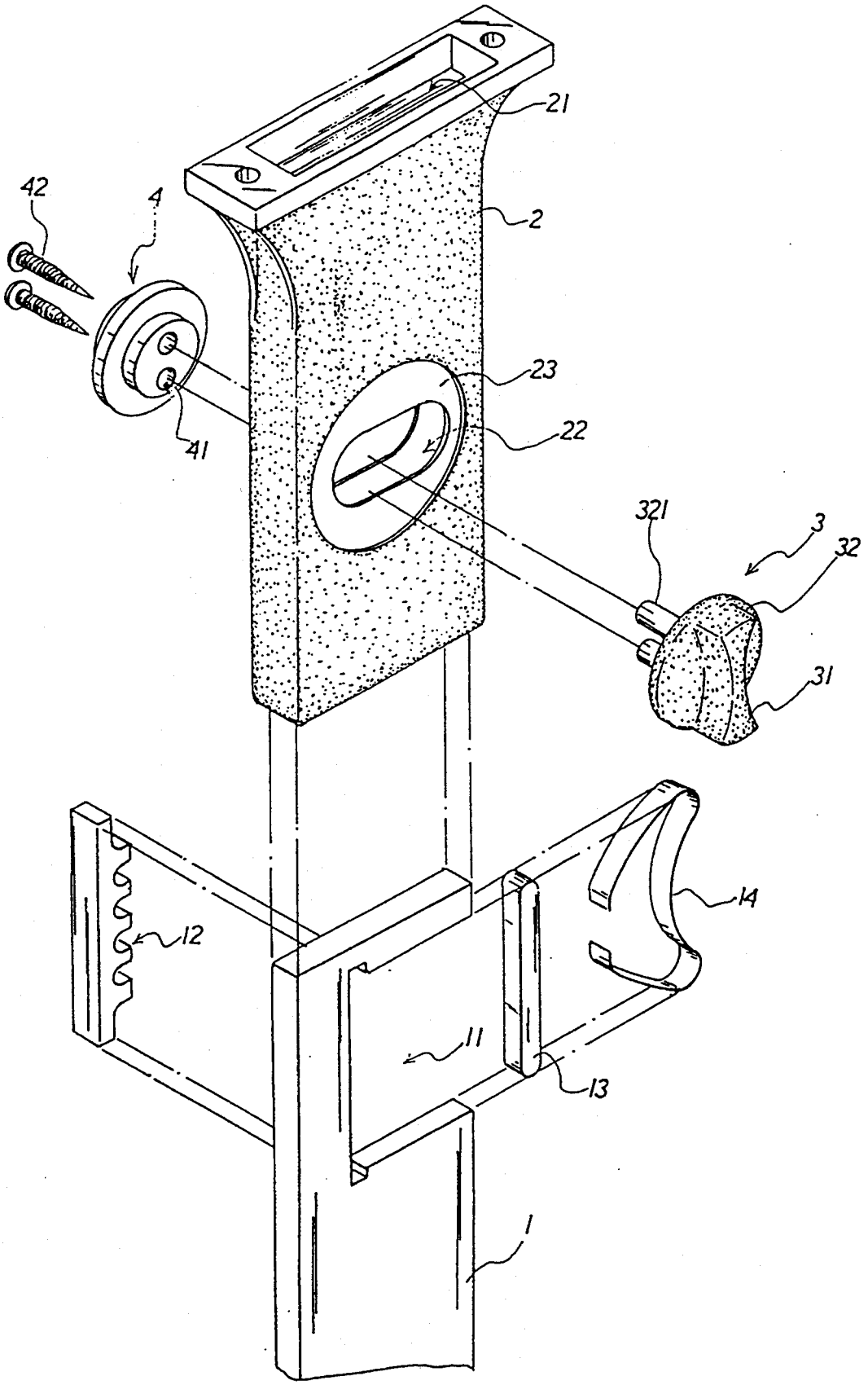
FIG. 1 PRIOR ART
FIG. 1 is a perspective exploded view of a conventional armrest-adjusting mechanism.
Figure 2:
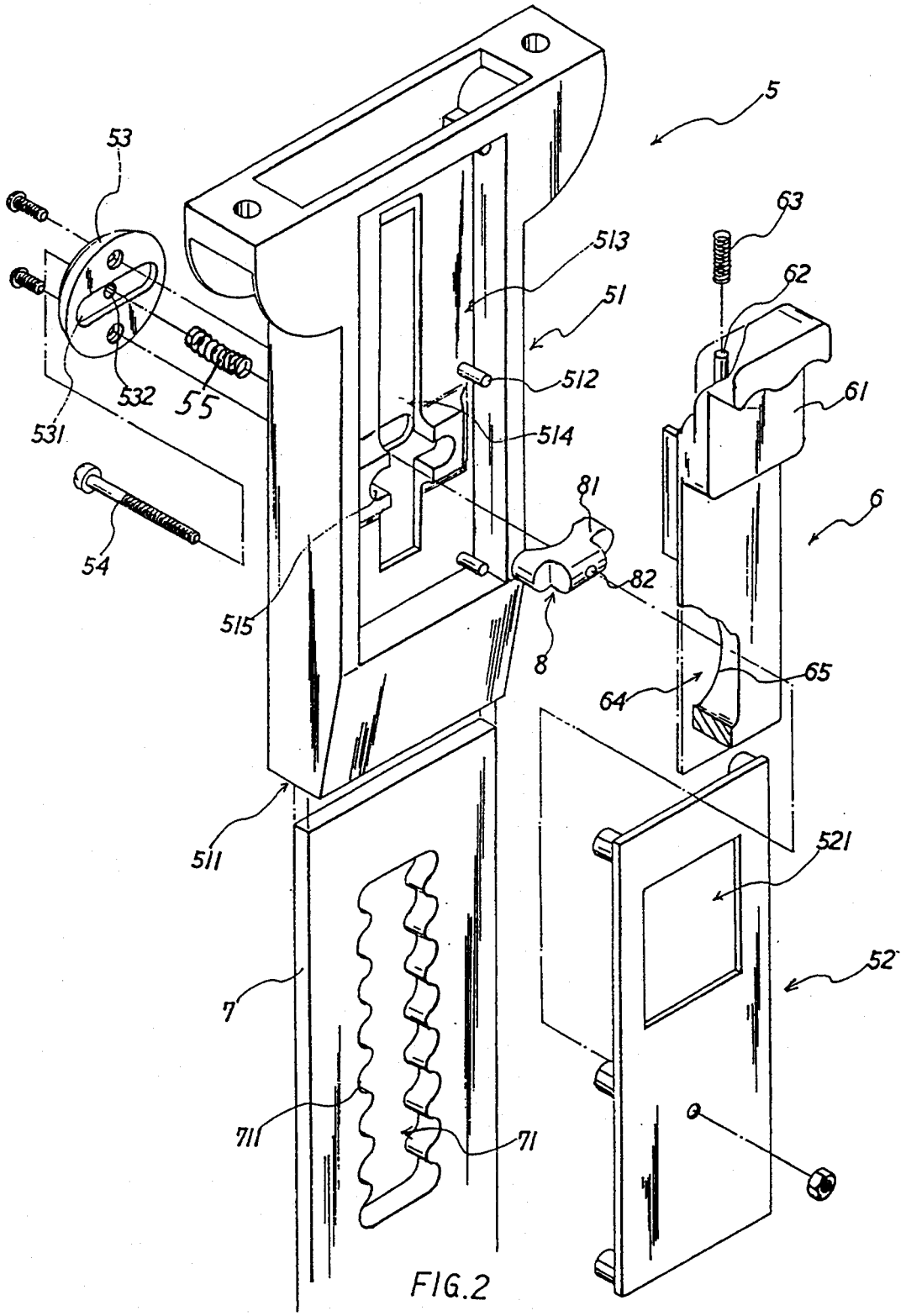
FIG. 2 is a perspective exploded view of the present invention.
Figure 3:
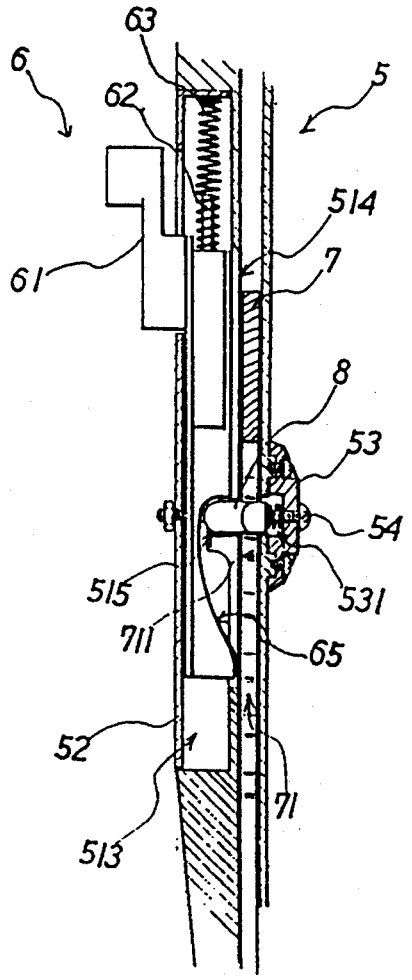
FIG. 3 is a sectional assembled view of the present invention.

Please refer to FIGS. 1 and 2. The armrest-adjusting mechanism of the present invention includes a housing 5, a control board 6, a lower support 7 and a locking block 8.

The housing 5 includes a seat body 51, a cover board 52 having a window 521 and a fixing board 53. The seat body 51 is formed with an interior space 511 for the lower support 7 to fit thereinto, a depression 513 located on one side of the seat body 51 for the cover board 52 to engage therewith, and a fixing pin 512 located in the depression 513. A lengthwise slot 514 is formed in the depression 513 and a transverse slot 515 is formed across the lengthwise slot 514 for receiving the locking block 8. The fixing board 53 is secured on the other side of the seat body 51 by screws and formed with a depression 531 for receiving the locking block 8. A through hole 532 is formed on a central portion of the depression 531 for a bearing bolt 54 to pass therethrough.

The control board 6 has a pull portion 61 extending upward from an upper end of the control board 6 and a support post 62 located beside the pull portion 61, whereby the support post 62 is fitted with a compression spring 63. A cut 64 is formed on a lower portion of the control board 6 for the bearing bolt 54 to move therewithin. Two arch pressing portions 65 are respectively formed on two sides of a bottom portion of the cut 64.

The lower support 7 is integrally formed, having a lengthwise slot 71. Each lateral side of the slot 71 is formed with multiple equally spaced arch adjusting notches 711.

The locking block 8 is formed with two lateral locking portions 81 corresponding to the arch adjusting notches 71 of the lower support 7 and a central through hole 82 for the bearing bolt 54 to pass therethrough.

According to the above arrangements, the lower support 7 is fitted into the interior space 511 of the seat body 51 of the housing 5 and the bearing bolt 54 is extended through the through hole 532 of the fixing board 53 and fitted with a bearing spring 55. The bearing bolt 54 further passes through the locking block 8, control board 6 and cover board 52 to engage with a nut. The control board 6 extends through the window 521 of the cover board 52 to contact with the locking block 8. The compression spring 63 is compressed between the support post 62 of the control board 6 and the seat body 51. By means of the biasing of the bearing spring 55 and the pressing of the control board 6, the locking portion 81 of the locking block 8 is locked in the arch adjusting notches 711 of the lower support 7 so that the housing 5 is fixedly engaged with the lower support 7.

When it is desired to adjust the height of the armrest, the control board 6 is pulled upward via the pull portion 61 to contract the compression spring 63. At this time, the arch pressing portions 65 of the control board 6 press the locking block 8 inward and contract the bearing spring 55, making the locking portion 81 of the locking block 8 separate from the arch adjusting notches 711. At this time, the armrest can be adjusted to a desired height. Thereafter, the control board 6 is released and restored to its original position by the resilient force of the compression spring 63. Simultaneously, the locking block 8 is restored to its original position by the resilient force of the bearing spring 55 and again lock in the arch adjusting notches 711 of the lower support 7.

The present invention has several advantages as follows:

1. The height of the armrest is adjusted and fixed by one operation.
2. The adjustment is accomplished by less force.
3. The assembling procedure of the components of the present invention is easily performed.

The above preferred embodiment is only an example of the present invention and the scope of the present invention should not be limited to the example. Any modification or variation derived from the example should fall within the scope of the present invention.

What is claimed is:

1. An armrest-adjusting mechanism comprising:

a housing having an interior space and a depression on a first side of the housing, each of a first lengthwise slot and a transverse slot formed across said first lengthwise slot located in said depression, a control board slidably engaged in said depression and said first lengthwise slot, an upper end of said control board having a pull portion and a support post located beside said pull portion, said support post having a first compression spring thereon which bears against a wall of said depression, a lower end of said control board having an arcuate tapering section, a lower support having a second lengthwise slot, each lateral side of said second lengthwise slot having arch shaped notches facing each other, a locking block slidably engaged in said transverse slot of the depression, said locking block spring biased by a second compression spring between a fixing board joined to a second side of the housing and said arcuate tapering section, said locking block having sides selectively engaged or disengaged in or from a pair of said arched shaped notches, a cover board having a window fixed over said depression and said control board with said pull portion extending through said window, wherein when said control board is moved upward by said pull portion against said first compression spring and said arcuate tapering section moves said locking board against said second compression spring to disengage from said lower support to permit sliding adjustment of said housing in relation to said lower support and after release of said pull portion, said first compression spring returns said control board to a rest position, and wherein said locking block is spring biased by said second compression spring to engage a pair of said arch shaped notches opposite the sides of the locking block in the selected position of the housing in relation to the lower support.

* * * * *